US011555647B2

(12) United States Patent
Dehury et al.

(10) Patent No.: US 11,555,647 B2
(45) Date of Patent: Jan. 17, 2023

(54) REAR BRACKET FOR SHELF ASSEMBLY

(71) Applicant: WHIRLPOOL CORPORATION, Benton Harbor, MI (US)

(72) Inventors: Ratikanta Dehury, Angul (IN); Sai B. Krishna, Pune (IN); Mandar G. Kulkarni, Pune (IN); Vishal S. Marathe, Pune (IN); Gaurav R. Shete, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/773,198

(22) Filed: Jan. 27, 2020

(65) Prior Publication Data

US 2021/0231363 A1 Jul. 29, 2021

(51) Int. Cl.

| | |
|---|---|
| ***F25D 25/02*** | (2006.01) |
| ***F25D 23/06*** | (2006.01) |
| ***A47B 57/06*** | (2006.01) |
| *A47B 73/00* | (2006.01) |

(52) U.S. Cl.

CPC ..... *F25D 25/02* (2013.01); *A47B 57/06* (2013.01); *F25D 23/067* (2013.01); *A47B 73/008* (2013.01)

(58) Field of Classification Search

CPC .. F25D 25/02; F25D 23/067; F25D 2325/021; F25D 23/066; A47B 57/06; A47B 96/027; A47B 57/32; A47B 57/42; A47B 57/36; A47B 57/08; A47B 57/425; A47B 73/008; A47B 57/52

See application file for complete search history.

(56) References Cited

U.S. PATENT DOCUMENTS

| | | | | |
|---|---|---|---|---|
| 3,234,897 A * | 2/1966 | Berk | A47B 57/42 108/152 |
| 3,983,823 A * | 10/1976 | McDonnell | A47B 57/18 108/147.11 |
| 4,365,562 A * | 12/1982 | Webb | F25D 25/02 108/108 |
| 4,443,979 A * | 4/1984 | Varon | E04B 2/78 29/463 |
| 5,004,302 A * | 4/1991 | Stocking | A47B 57/42 108/107 |
| 5,791,502 A * | 8/1998 | Bietz | A47B 57/50 211/192 |
| 6,644,609 B1 * | 11/2003 | Scott | A47B 57/42 248/243 |
| 8,651,600 B2 | 2/2014 | Cheong et al. | |

(Continued)

FOREIGN PATENT DOCUMENTS

KR 20040068389 A 7/2004

*Primary Examiner* — Hiwot E Tefera
(74) *Attorney, Agent, or Firm* — Price Heneveld LLP

(57) ABSTRACT

A rear bracket for a wall-mounted, appliance shelf assembly includes a central portion that defines a plurality of receiving wells. A first mounting portion extends parallel to the central portion and is configured to align with a first wall of an appliance cabinet. A second mounting portion extends perpendicular to the central portion and is configured to align with a second wall of the appliance cabinet. The second wall is positioned perpendicular to the first wall. A first fastener is configured to couple the first mounting portion with the first wall. A second fastener is configured to couple the second mounting portion with the second wall.

17 Claims, 7 Drawing Sheets

(56) References Cited

U.S. PATENT DOCUMENTS

| | | | | |
|---|---|---|---|---|
| 8,944,621 | B2 | 2/2015 | Driver et al. | |
| 10,281,199 | B2 | 5/2019 | Yang et al. | |
| 2008/0030114 | A1 | 2/2008 | Becke | |
| 2008/0197253 | A1* | 8/2008 | Thompson | A47B 96/1416 52/36.5 |
| 2009/0302726 | A1* | 12/2009 | Eckartsberg | F25D 23/067 29/700 |
| 2010/0175420 | A1* | 7/2010 | Kim | F25D 25/02 62/465 |
| 2013/0160483 | A1* | 6/2013 | Hasturk | F25D 25/02 62/452 |
| 2013/0277323 | A1* | 10/2013 | Cheong | A47B 57/42 211/119.003 |
| 2014/0252939 | A1* | 9/2014 | Tunzi | A47B 57/08 312/408 |
| 2015/0201762 | A1* | 7/2015 | Walter | A47F 5/0853 211/187 |
| 2017/0258249 | A1* | 9/2017 | Kim | A47F 5/08 |
| 2018/0164021 | A1* | 6/2018 | Lindel | F25D 17/065 |

* cited by examiner

REAR BRACKET FOR SHELF ASSEMBLY

FIELD OF DISCLOSURE

The present disclosure generally relates to a rear bracket, and more specifically, to a rear bracket for a shelf assembly.

BACKGROUND

Refrigerator appliance shelves may be mounted to a wall of the appliance and configured to support various goods including bottles. Where a shelf is configured to support bottles (e.g., a wine bottle rack), additional bracket support may be needed.

SUMMARY OF THE DISCLOSURE

According to one aspect of the present disclosure, a rear bracket for a wall-mounted, appliance shelf assembly includes a central portion that defines a plurality of receiving wells. A first mounting portion is configured to align with a first wall of an appliance cabinet. The first mounting portion has a planar extent that extends parallel to a planar extent of the central portion. A second mounting portion is configured to align with a second wall of the appliance cabinet. The second mounting portion has a planar extent that extends perpendicular to the planar extent of the central portion. The second wall is positioned perpendicular to the first wall. A first fastener is configured to couple the first mounting portion with the first wall. A second fastener is configured to couple the second mounting portion with the second wall.

According to another aspect of the present disclosure, a wall-mounted shelf assembly for an appliance includes a rear bracket operably coupled with an appliance cabinet. The rear bracket includes a central portion that defines a plurality of receiving wells. A first mounting portion is aligned with a first wall of the appliance cabinet. The first mounting portion has a planar extent that extends parallel to a planar extent of the central portion. A second mounting portion is aligned with a second wall of the appliance cabinet. The second mounting portion has a planar extent that extends perpendicular to the planar extent of the central portion. The second wall is positioned perpendicular to the first wall. A shelf is configured to be operably coupled with the rear bracket.

According to yet another aspect of the present disclosure, a wall-mounted shelf assembly for an appliance includes a rear bracket operably coupled with an appliance cabinet. The rear bracket includes a central portion that defines a plurality of receiving wells. A first mounting portion is operably coupled with a first wall of the appliance cabinet. The first mounting portion has a planar extent that extends parallel to a planar extent of the central portion. A second mounting portion is operably coupled with a second wall of the appliance cabinet. The second mounting portion has a planar extent that extends perpendicular to the planar extent of the central portion. A shelf is configured to be operably coupled with the rear bracket. A cover is configured to be positioned over the second mounting portion to at least partially conceal the rear bracket.

These and other features, advantages, and objects of the present disclosure will be further understood and appreciated by those skilled in the art by reference to the following specification, claims, and appended drawings.

Figure 1:
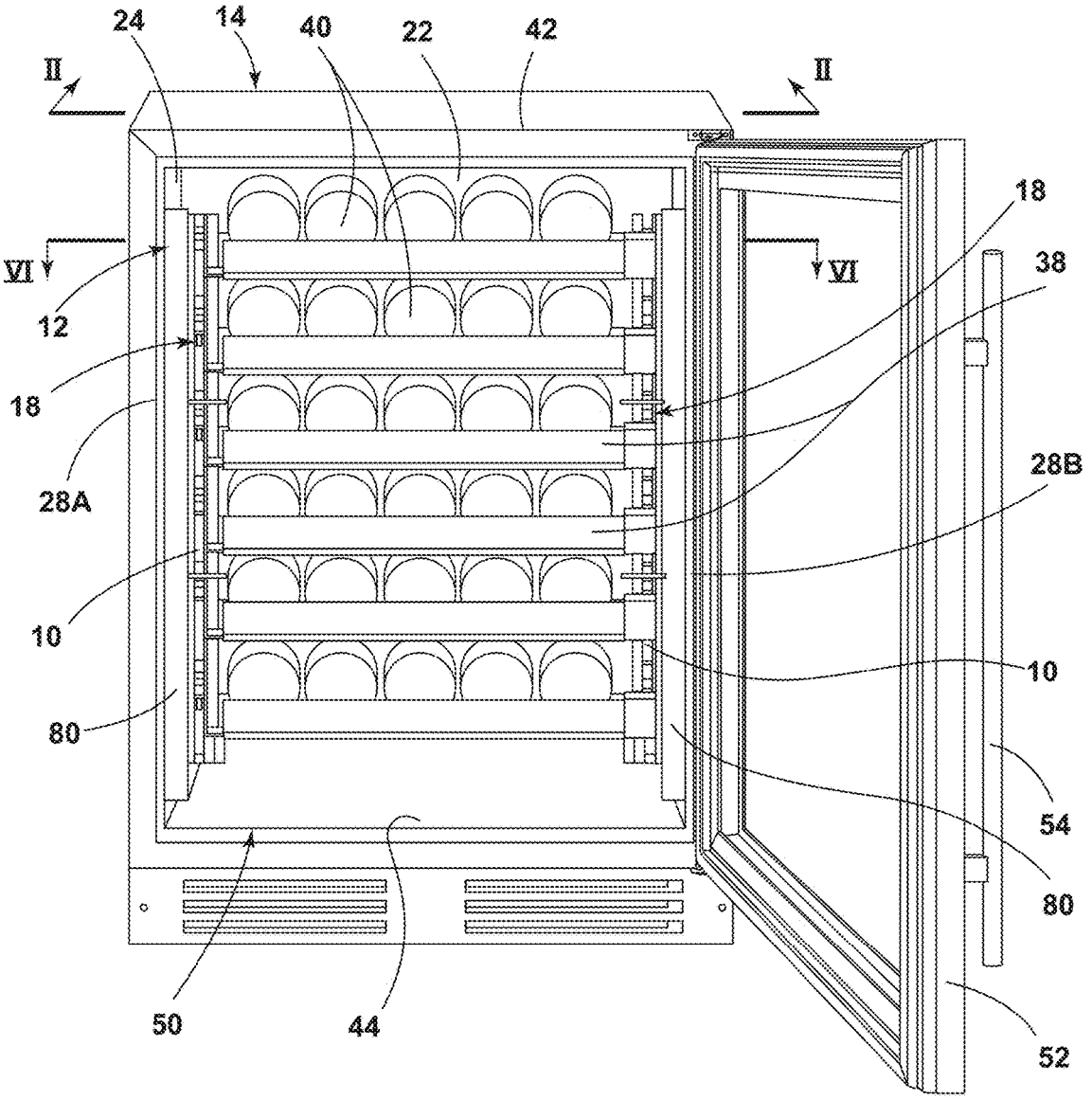
FIG. 1 is a front perspective view of an appliance including a shelf assembly, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a rear bracket for a shelf assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-7, reference numeral 10 generally designates a rear bracket for a wall-mounted shelf assembly 12 for an appliance 14. The rear bracket 10 includes a central portion 16 that defines a plurality of receiving wells 18. A first mounting portion 20 extends parallel to the central portion 16 and is configured to align with a rear wall 22 of a cabinet 24 of the appliance 14. A second mounting portion 26 extends perpendicular to the central portion 16 and is configured to align with a sidewall 28A, 28B of the cabinet 24. The sidewall 28A, 28B is positioned perpendicular to the rear wall 22. A first fastener 30 is configured to couple the first mounting portion 20 with the rear wall 22. A second fastener 32 is configured to couple the second mounting portion 26 with the sidewall 28A, 28B.

Referring now to FIG. 1, the appliance 14 is illustrated as a wine cooler including the wall-mounted shelf assembly 12. The appliance 14 includes the cabinet 24 configured to house the wall-mounted shelf assembly 12. The first and second sidewalls 28A, 28B of the cabinet 24 are spanned by the rear wall 22. A top wall 42 and a bottom wall 44 are spaced apart by the first and second sidewalls 28A, 28B and the rear wall 22. The cabinet 24 may include a continuous interior surface extending along one or more of the sidewalls 28A, 28B, the rear wall 22, the top wall 42, and the bottom wall 44.

A plurality of shelves 38 are positioned within the cabinet 24 and extend between the first and second sidewalls 28A, 28B. In various examples, the plurality of shelves 38 may be parallel with the top wall 42 and/or the bottom wall 44. However, it is contemplated that the plurality of shelves 38 may have any orientation configured to retain bottles 40 without departing from the scope of the present disclosure.

The cabinet 24 further defines an access opening 50. A door assembly 52 may selectively cover the access opening 50, and a handle 54 may be provided to facilitate the opening and closing of the door assembly 52. Although the appliance 14 is illustrated as a wine cooler, or wine cellar, it is contemplated that the appliance 14 may be in the form of any appliance, which may include cooling appliances such as a refrigerator, a freezer, and any combination thereof. In some examples, the appliance 14 may include a vacuum insulated cooling appliance.

Referring still to FIG. 1, the wall-mounted shelf assembly 12 has one or more rear brackets 10. For example, as illustrated, the rear bracket 10 may be one of a pair of rear brackets 10. The rear bracket 10 is positioned proximate one of the first sidewall 28A and the second sidewall 28B of the cabinet 24. The rear bracket 10 is operably coupled with the rear wall 22 of the cabinet 24 and extends longitudinally between the top wall 42 and the bottom wall 44. The rear bracket 10 may extend from the top wall 42 to the bottom wall 44 or may be spaced apart from one or both of the top and bottom walls 42, 44. The plurality of shelves 38 are configured to be selectively engaged with the rear bracket 10, as discussed in more detail below.

Figure 2:
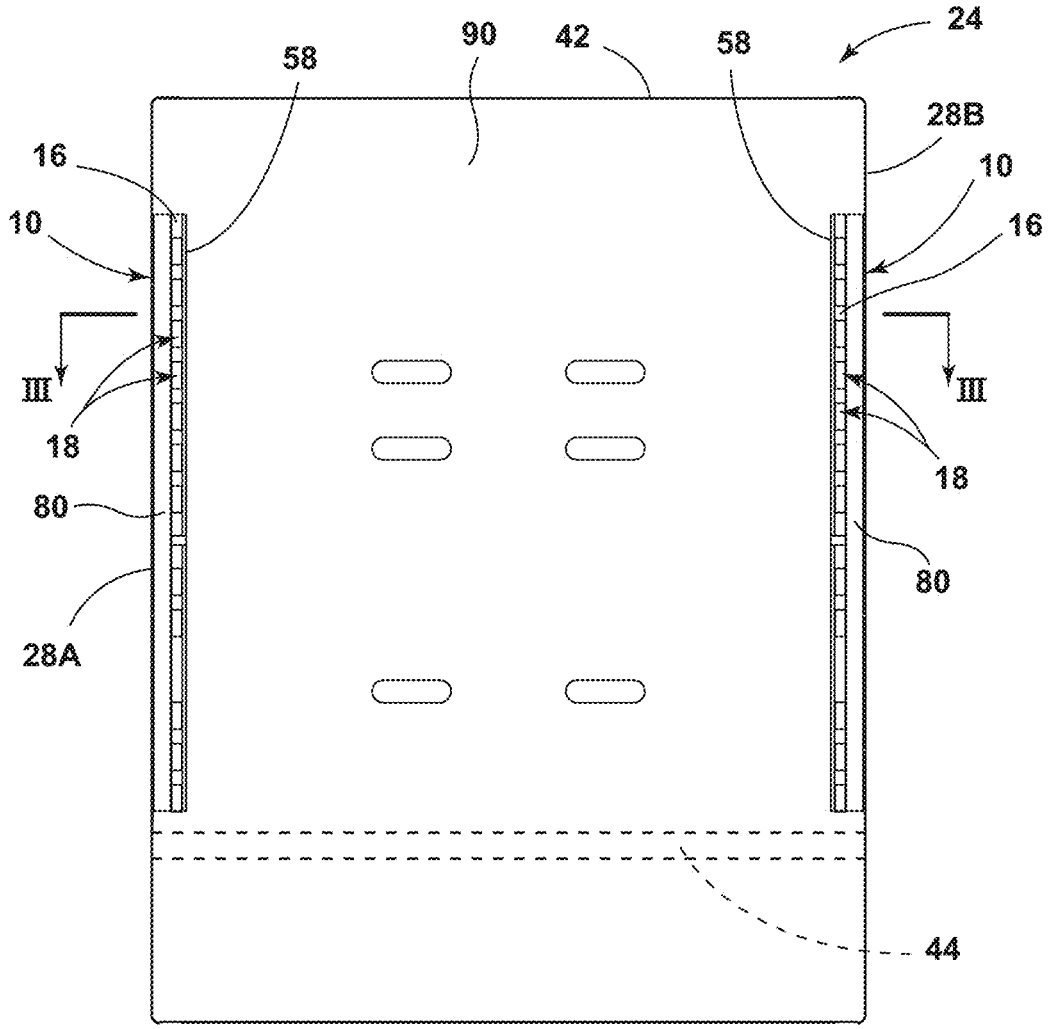
FIG. 2 is a cross-sectional elevation view of a cabinet of the appliance of FIG. 1 taken along line II-II with shelves of the shelf assembly removed to expose rear brackets.
Figure 3:
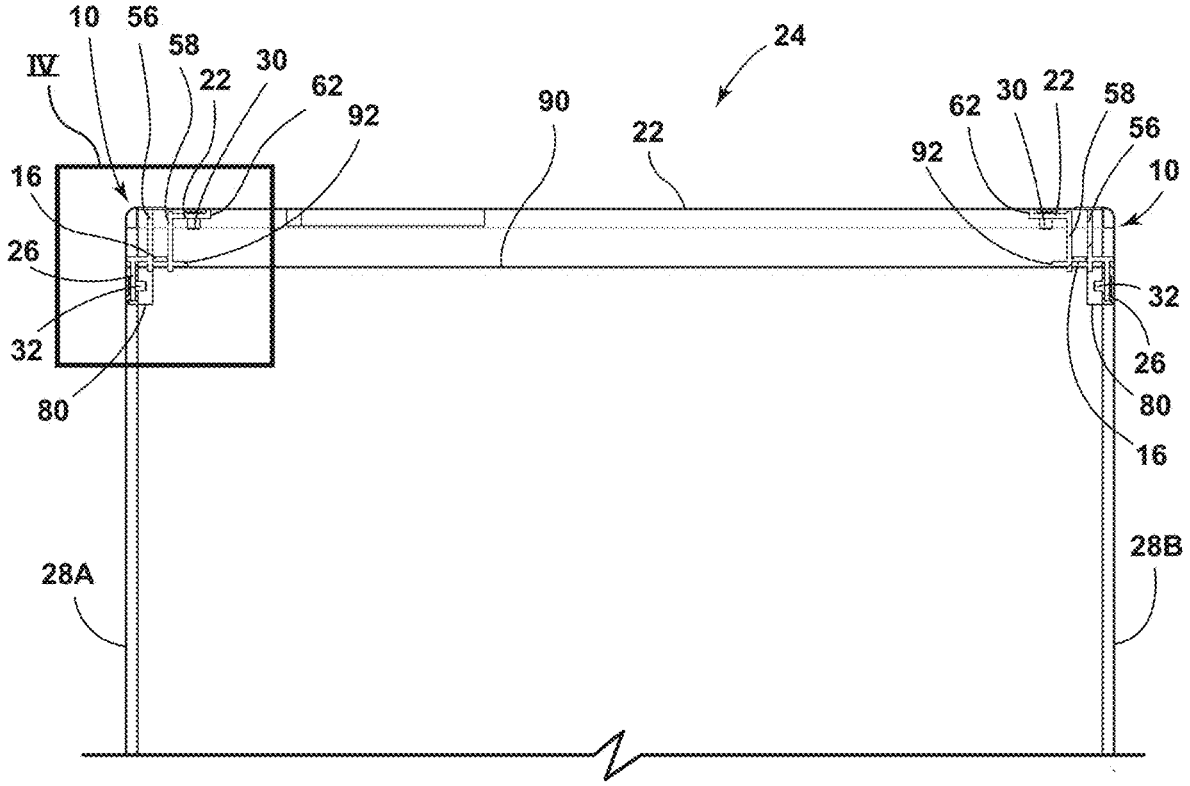
FIG. 3 is a cross-sectional view of the cabinet of the appliance of FIG. 2 taken along line III-Ill.
Figure 4:
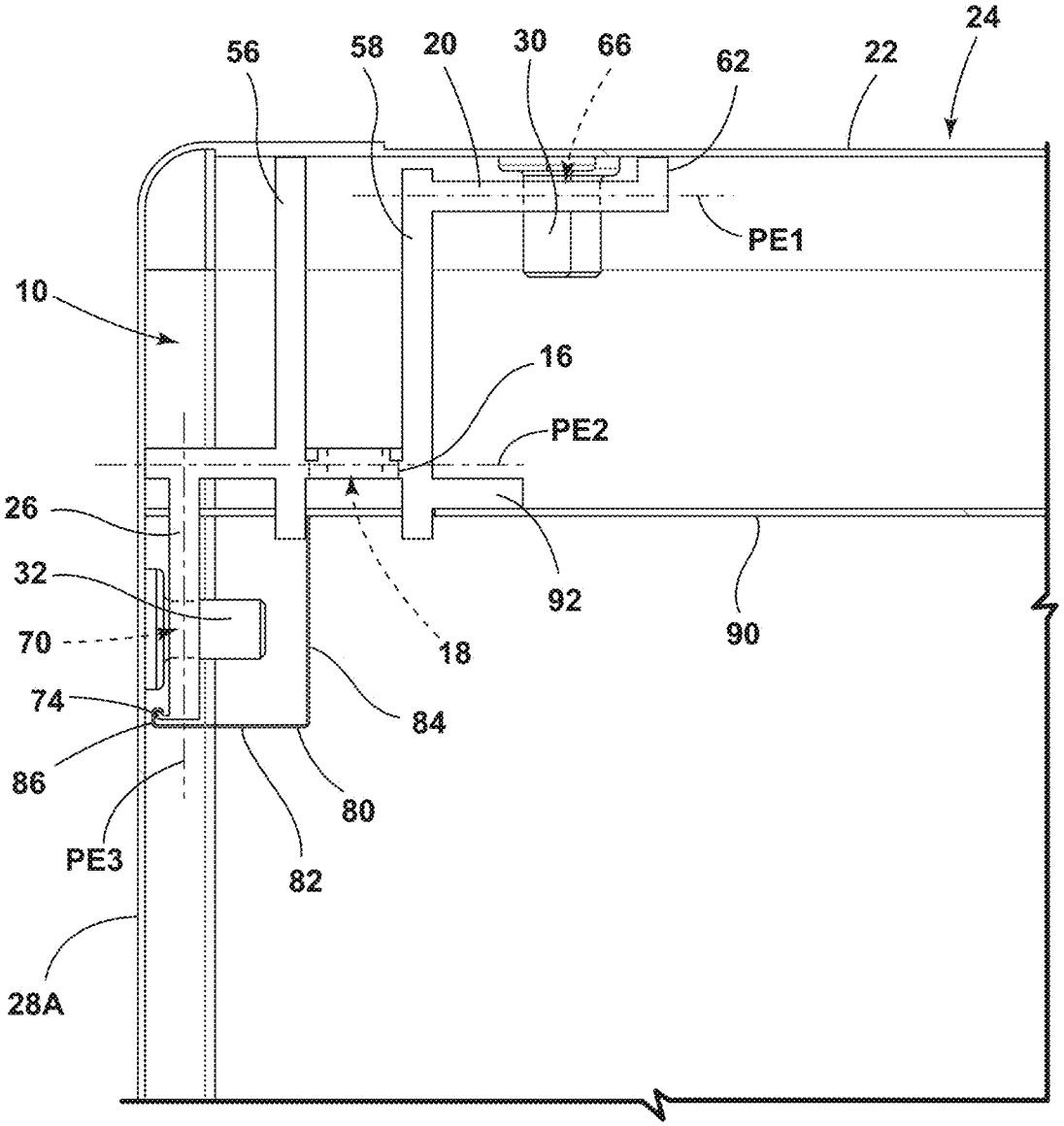
FIG. 4 is an enlarged view of section IV of FIG. 3 illustrating a cross-section of a first bracket.

Referring now to FIGS. 2-4, the cabinet 24 is illustrated with the plurality of shelves 38 removed such that the rear bracket 10 is visible. The rear bracket 10 is coupled with the cabinet 24 as one of a pair of rear brackets 10. It will be understood that, where a pair of brackets 10 is used, as illustrated, each bracket 10 of the pair of brackets 10 has the same or similar components. The components of one of the rear brackets 10 may be mirrored to engage with the respective sidewall 28A, 28B.

As illustrated in FIGS. 2-5B, the rear bracket 10 includes a central portion 16 that extends along the rear wall 22 and defines a plurality of receiving wells 18. The plurality of receiving wells 18 are spaced longitudinally along the central portion 16. The plurality of receiving wells 18 may be equally spaced along the central portion 16 of the bracket 10 or may be unequally spaced along the central portion 16. Each of the plurality of receiving wells 18 may be generally rectangular, as illustrated. However, it is contemplated that each of the plurality of receiving wells 18 may have any shape and size configured to engage with one of the plurality of shelves (FIGS. 6 and 7) without departing from the scope of the present disclosure.

Referring now to FIGS. 3-5B, the rear bracket 10 includes first and second central extensions 56, 58. The first central extension 56 is positioned between the second central extension 58 and one of the first and second sidewalls 28A, 28B. The first and second central extensions 56, 58 extend from the central portion 16 towards the rear wall 22. In various examples, the first and second central extensions 56, 58 may abut the rear wall 22. The first central extension 56 extends from the central portion 16 on a first side of the plurality of receiving wells 18, and the second central extension 58 extends from the central portion 16 on a second side of the plurality of receiving wells 18. In other words, the first and second central extensions 56, 58 are spaced apart by a distance determined by a width of the plurality of receiving wells 18.

The first and second central extensions 56, 58 are integrally formed with the central portion 16. In various examples, the first and second central extensions 56, 58 may extend forward of the central portion 16 such that the first and second central extensions 56, 58 intersect the central portion 16. Where the first and second central extensions 56, 58 extend forward from the central portion 16, the first and second central extensions 56, 58 frame the plurality of receiving wells 18.

With continued reference to FIGS. 3-5B, the rear bracket 10 further includes the first mounting portion 20, as introduced above. The first mounting portion 20 is configured to align with the rear wall 22 of the cabinet 24. The first mounting portion 20 extends from the second central extension 58 at a right angle and is spaced apart from the rear wall 22. A foot 62 extends from an end of the first mounting portion 20 opposite the second central extension 58 to maintain the spacing of the first mounting portion 20 relative to the rear wall 22.

The first mounting portion defines a first opening 66 configured to receive the fastener 30. The first opening 66 may be generally circular and sized to receive the first fastener 30. Alternatively, the first opening 66 may be configured as a slot configured to slidably receive the first fastener 30 and extending horizontally across the first mounting portion 20. The spacing of the first mounting portion 20 relative to the rear wall 22 is configured to at least partially accommodate the first fastener 30 when the first fastener 30 is received through the first opening 66. As illustrated, the first fastener 30 may be a weld stud. However, it will be understood that the first fastener 30 may be a screw, adhesive, welding, or other fastener type based on the configuration of the cabinet 24 of the appliance 14.

As illustrated, the first opening 66 may be one of a plurality of first openings 66 that are longitudinally spaced apart along the first mounting portion 20. Where the first opening 66 is one of a plurality of first openings 66, the first fastener 30 may be one of a plurality of first fasteners 30. The number of first fasteners 30 may be the same or less than the number of first openings 66. The first mounting portion 20 is configured to be operably coupled with the real wall 22 by each of the plurality of fasteners 30 extending through one of the plurality of first openings 66.

Referring still to FIGS. 3-5B, the rear bracket 10 further includes a second mounting portion 26. The second mounting portion 26 extends from the central portion 16 of the rear bracket 10 and is configured to align with one of the first and second sidewalls 28A, 28B of the cabinet 24. The second mounting portion 26 is spaced apart from the first central extensions 56 and is further spaced apart from one of the first and second sidewalls 28A, 28B.

The second mounting portion 26 defines a second opening 70 configured to receive the second fastener 32. The second opening 70 may be generally circular and sized to receive the second fastener 32. Alternatively, the second opening 70 may be configured as a slot extending horizontally across the second mounting portion 26. The second opening 70 as a slot may be configured to slidably receive the first fastener 30. As illustrated, the second fastener 32 may be a weld stud. However, it will be understood that the second fastener 32 may be a screw, adhesive, welding, or other fastener type based on the configuration of the cabinet 24 of the appliance 14. It is further contemplated that the first and second fasteners 30, 32 may be the same type of fastener or may be different types of fasteners without departing from the scope of the present disclosure.

As illustrated, the second opening 70 may be one of a plurality of second openings 70 spaced longitudinally along the second mounting portion 26. Where the second opening 70 is one of a plurality of second openings 70, the second fastener 32 may be one of a plurality of second fasteners 32. The number of second fasteners 32 may be the same or less than the number of second openings 70. The second mounting portion 26 is configured to be operably coupled with the respective sidewall 28A, 28B by each of the plurality of second fasteners 32 extending through one of the plurality of second openings 70.

As illustrated in FIG. 4, the second mounting portion 26 includes an engagement feature 74. The engagement feature 74 extends from a terminal end of the second mounting portion 26. The engagement feature 74 has a cross-section that is generally hook-shaped and configured to engage with a retention hook 86, as discussed in more detail below. However, it is contemplated that the engagement feature 74 may have any cross-section configured to engage with the retention hook 86 without departing from the scope of the present disclosure.

Referring still to FIG. 4, the first mounting portion 20 of the rear bracket 10 includes a first planar extent PE1 positioned parallel to the rear wall 22. The first planar extent PE1 is further positioned parallel to a second planar extent PE2 of the central portion 16 of the bracket 10. The second mounting portion 26 further includes a third planar extent PE3 positioned perpendicular to both the first and second planar extents PE1, PE2. The third planar extent PE3 is oriented parallel with the respective sidewall 28A, 28B. This orientation gives the rear bracket 10 a cross-section that generally resembles steps.

Figure 5A:
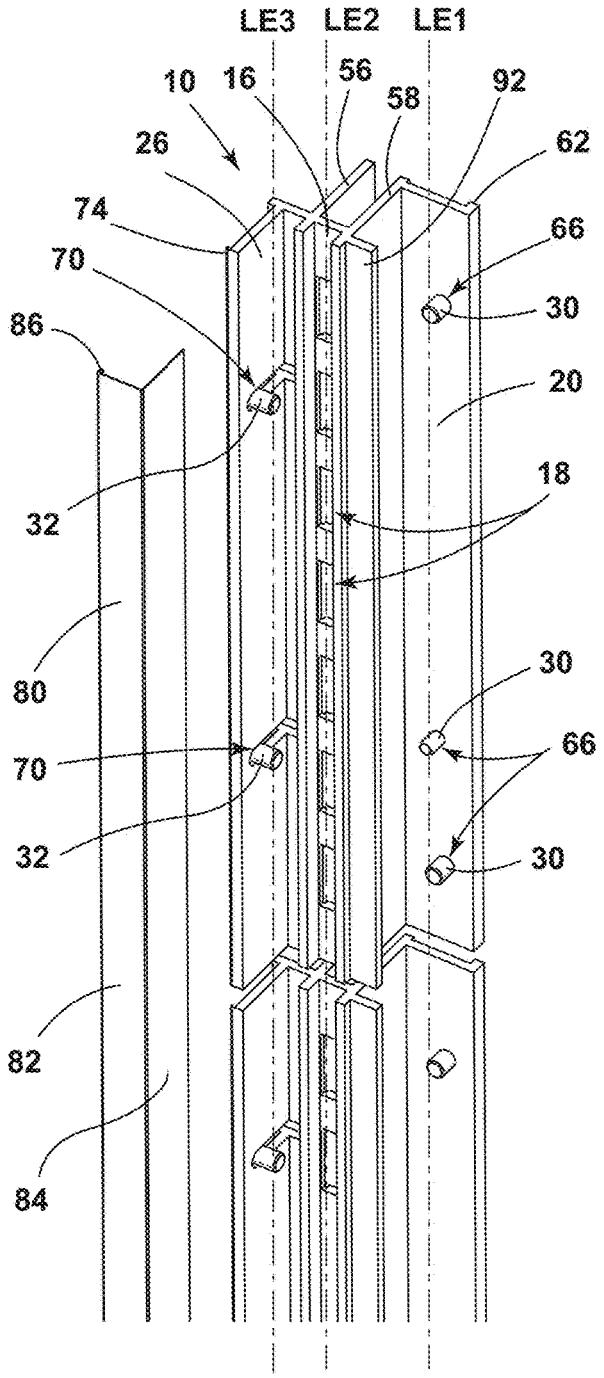
FIG. 5A is a side perspective view of a first rear bracket, according to various examples.
Figure 5B:
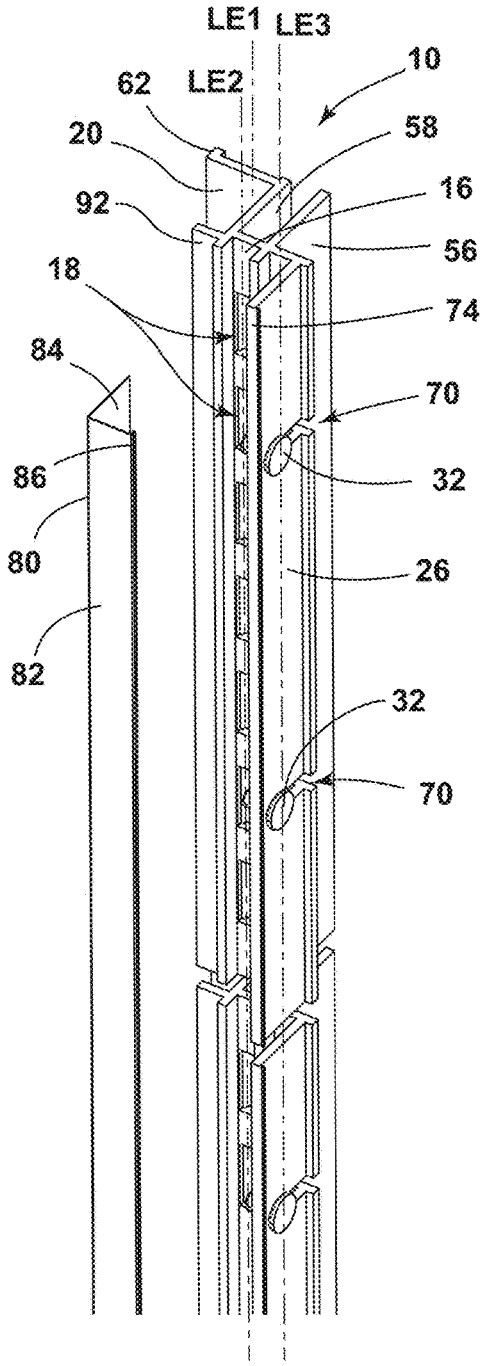
FIG. 5B is a side perspective view of a second rear bracket that mirrors the first rear bracket of FIG. 5A, according to various examples.

Referring now to FIGS. 5A and 5B, the first mounting portion 20 of the bracket 10 is such that a first longitudinal extent LE1 of the first mounting portion 20 is parallel with a second longitudinal extent LE2 of the central portion 16. Further, a third longitudinal extent LE3 of the second mounting portion 26 is parallel with the second longitudinal extent LE2 and the first longitudinal extent LE1.

Referring again to FIGS. 3-5B, the shelf assembly 12 further includes a cover 80 operably coupled with the rear bracket 10. The cover 80 is configured to be positioned over the second mounting portion 26 of the rear bracket 10 to at least partially conceal the rear bracket 10 (FIGS. 2 and 3). The cover 80 may be formed of a material configured to match or complement the interior surface of the appliance 14. Alternatively, the cover 80 may be formed any material configured to provide a desired aesthetic appearance within the appliance 14 (e.g., the cover 80 may be metallic, colored, etc.).

The cover 80 includes a first leg 82 positioned perpendicular to a second leg 84. The cover 80 is sized to cover at least the second fastener 32 and the second mounting portion 26. The first leg 82 of the cover 80 is generally planar and includes the retention hook 86 extending longitudinally along an end of the first leg 82, as introduced above. The retention hook 86 extends from the first leg 82 and is configured to be engaged with the engagement feature 74 of the second mounting portion 26. The retention hook 86 may be configured to fit over the engagement feature 74 of the second mounting portion 26. Alternatively, the retention hook 86 may be configured to engage with the engagement feature 74 by any other method configured to couple the cover 80 with the rear bracket 10.

The second leg 84 of the cover 80 is generally planar and may be positioned to abut the first central extension 56 between the first and second central extensions 56, 58. When the second leg 84 abuts, and/or is aligned with, the first central extension 56 forward of the central portion 16 of the rear bracket 10, the retention hook 86 of the first leg 82 of the cover 80 may be engaged with the engagement feature 74 of the bracket 10.

Referring again to FIGS. 2-4, a liner member 90 may be positioned within the cabinet 24 parallel with the rear wall 22 of the cabinet 24. Where the rear bracket 10 is one of a pair of rear brackets 10, the liner member 90 may extend between the rear brackets 10 to further conceal the brackets 10 and/or the rear wall 22 of the cabinet 24. The rear bracket 10 may include a support 92 extending from the second central extension 58 proximate the central portion 16 of the rear bracket 10. The support 92 is configured to engage with the liner member 90 to support and align the liner member 90 within the cabinet 24.

Figure 6:
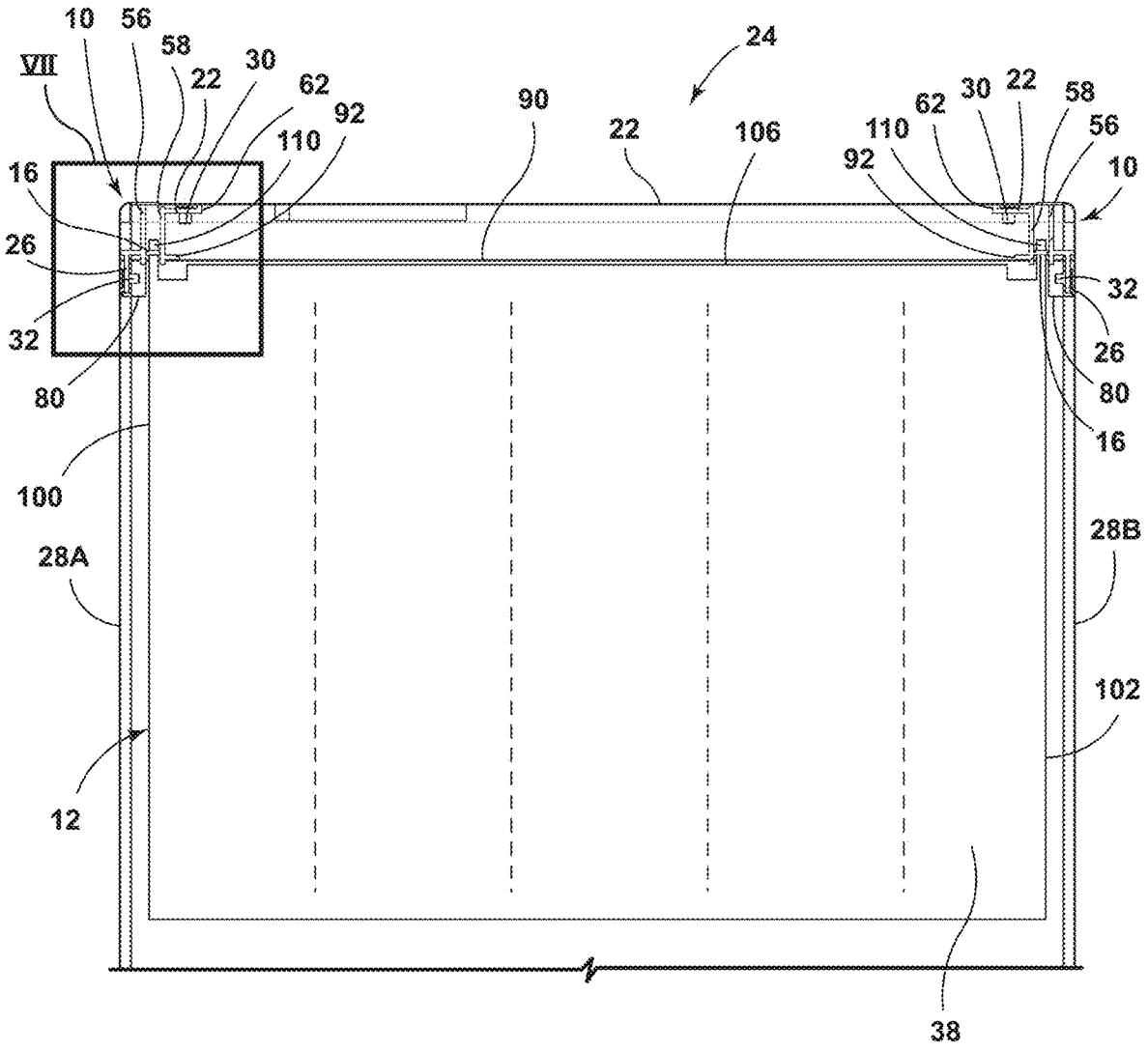
FIG. 6 is a cross-sectional view of a cabinet of the appliance of FIG. 1 taken along line VI-VI.
Figure 7:
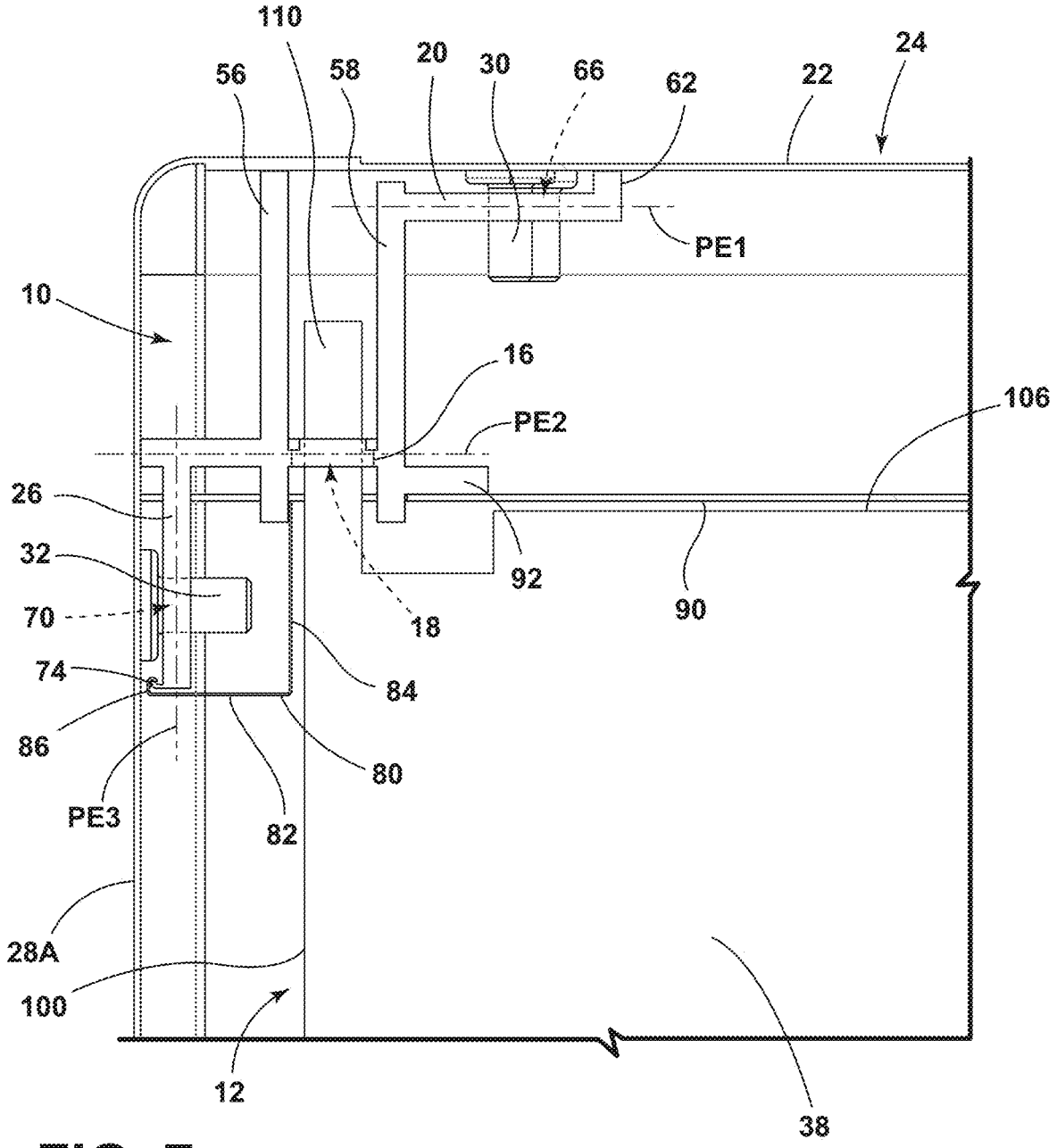
FIG. 7 is an enlarged view of section VII of FIG. 6 illustrating a cross-section of a first bracket.

Referring now to FIGS. 6 and 7, as previously introduced, the rear bracket 10 is configured to at least partially support a plurality of shelves 38 of the shelf assembly 12. The plurality of shelves 38 may be any number of shelves less than or equal to the number of receiving wells 18 defined by the central portion 16. Each of the plurality of shelves 38 is configured to be coupled with the rear bracket 10, as discussed in more detail below.

Each of the plurality of shelves 38 includes first and second edges 100, 102 aligned with the first and second sidewalls 28A, 28B of the cabinet 24. The first and second edges 100, 102 are integrally formed with a rear edge 106 aligned with one of the liner member 90 and the rear wall 22. While the plurality of shelves 38 are illustrated as bottle racks, it is contemplated that any storage feature may be supported by the rear bracket 10, including, for example, baskets, planar shelves, or sliding shelves.

Each shelf of the plurality of shelves 38 includes a plurality of hooks 110 extending from the rear edge 106. Each of the plurality of hooks 110 is configured to be received by one of the plurality of receiving wells 18 of the rear bracket 10. Each of the hooks 110 is selectively and removably engaged with one of the receiving wells 18. In various examples, where the first and second central extensions 56, 58 extend forward of the central portion 16 to frame the plurality of receiving wells 18, the first and second central extension 56, 58 may be configured to guide the hooks 110 into engagement with the respective receiving wells 18. The engagement between the plurality of hooks 110 and the plurality of receiving wells 18 couples the shelf 38 with the rear bracket 10. When the shelf 38 is coupled with the rear bracket 10, the second leg 84 of the cover 80 is aligned with, and may abut, one of the first and second edges 100, 102 of the shelf 38

Referring again to FIGS. 1-7, the orientation of the first and second mounting portions 20, 26 with respect to the central portion 16 of the bracket 10 may provide additional support for the plurality of shelves 38. Further, the positioning of the cover 80 over the second mounting portion 26 of the bracket 10 provides an aesthetically pleasing appearance for the rear bracket 10 of the shelf assembly 12.

According to one aspect, a rear bracket for a wall-mounted, appliance shelf assembly includes a central portion that defines a plurality of receiving wells. A first mounting portion is configured to align with a first wall of an appliance cabinet. The first mounting portion has a planar extent that extends parallel to a planar extent of the central portion. A second mounting portion is configured to align with a second wall of the appliance cabinet. The second mounting portion has a planar extent that extends perpendicular to the planar extent of the central portion. The second wall is positioned perpendicular to the first wall. A first fastener is configured to couple the first mounting portion with the first wall. A second fastener is configured to couple the second mounting portion with the second wall.

According to another aspect, first and second fasteners are weld studs.

According to another aspect, a longitudinal extent of a first mounting portion is parallel to a longitudinal extent of a second mounting portion.

According to another aspect, a rear bracket includes first and second central extensions that extend from a central portion and that are positioned to space the central portion away from a first wall.

According to another aspect, a first mounting portion extends from one of first and second central extensions.

According to another aspect, a first mounting portion includes a foot to space the first mounting portion away from a first wall.

According to another aspect, a wall-mounted shelf assembly for an appliance includes a rear bracket operably coupled with an appliance cabinet. The rear bracket includes a central portion that defines a plurality of receiving wells. A first mounting portion is aligned with a first wall of the appliance cabinet. The first mounting portion has a planar extent that extends parallel to a planar extent of the central portion. A second mounting portion is aligned with a second wall of the appliance cabinet. The second mounting portion has a planar extent that extends perpendicular to the planar extent of the central portion. The second wall is positioned perpendicular to the first wall. A shelf is configured to be operably coupled with the rear bracket.

According to another aspect, a wall-mounted shelf assembly includes a first fastener configured to couple a first mounting portion with a first wall. A second fastener is configured to couple a second mounting portion with a second wall.

According to another aspect, first and second fasteners are weld studs.

According to another aspect, a first wall is a rear wall of an appliance cabinet.

According to another aspect, a shelf includes a hook configured to be received by one of a plurality of receiving wells.

According to another aspect, a shelf is configured as a bottle rack.

According to another aspect, a wall-mounted shelf assembly includes a cover operably coupled with a second mounting portion. The cover is configured to at least partially conceal a rear bracket.

According to another aspect, a cover is configured to match an interior surface of an appliance cabinet.

According to another aspect, a wall-mounted shelf assembly for an appliance includes a rear bracket operably coupled with an appliance cabinet. The rear bracket includes a central portion that defines a plurality of receiving wells. A first mounting portion is operably coupled with a first wall of the appliance cabinet. The first mounting portion has a planar extent that extends parallel to a planar extent of the central portion. A second mounting portion is operably coupled with a second wall of the appliance cabinet. The second mounting portion has a planar extent that extends perpendicular to the planar extent of the central portion. A shelf is configured to be operably coupled with the rear bracket. A cover is configured to be positioned over the second mounting portion to at least partially conceal the rear bracket.

According to another aspect, a wall-mounted shelf assembly includes first and second central extensions extending from a central portion and positioned to space the central portion away from a first wall.

According to another aspect, a shelf is configured to be at least partially received by one of a plurality of receiving wells.

According to another aspect, a cover is generally L-shaped.

According to another aspect, a shelf is at least partially flush with a cover.

According to another aspect, a cover is operably coupled with a second mounting portion It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A rear bracket for a wall-mounted, appliance shelf assembly, comprising:

a central portion defining a plurality of receiving wells;

a first mounting portion integrally formed with and fixedly attached to the central portion, the first mounting portion configured to align with a first wall of an appliance cabinet and having a planar extent that extends parallel to a planar extent of the central portion;

a second mounting portion extending forward of the receiving wells and integrally formed with and fixedly attached to the central portion and the first mounting portion, the second mounting portion configured to align with a second wall of the appliance cabinet and having a planar extent that extends perpendicular to the planar extent of the central portion, wherein the second wall is positioned perpendicular to the first wall;

a first fastener configured to couple the first mounting portion with the first wall;

a second fastener configured to couple the second mounting portion with the second wall; and first and second central extensions that extend from the central portion and that are positioned to space the central portion away from the first wall.

2. The rear bracket of claim 1, wherein the first mounting portion includes a foot to space the first mounting portion away from the first wall.

3. The rear bracket of claim 1, wherein the first mounting portion extends from one of the first and second central extensions.

4. The rear bracket of claim 1, wherein the first and second fasteners are weld studs.

5. The rear bracket of claim 1, wherein a longitudinal extent of the first mounting portion is parallel to a longitudinal extent of the second mounting portion.

6. A wall-mounted shelf assembly for an appliance, comprising:

a rear bracket operably coupled with an appliance cabinet, the rear bracket including:

a central portion defining a plurality of receiving wells;

a first mounting portion integrally formed with and fixedly attached to the central portion, the first mounting portion aligned with a first wall of the appliance cabinet and having a planar extent that extends parallel to a planar extent of the central portion; and a second mounting portion extending forward of the receiving wells and integrally formed with and fixedly attached to the central portion and the first mounting portion, the second mounting portion aligned with a second wall of the appliance cabinet and having a planar extent that extends perpendicular to the planar extent of the central portion, wherein the second wall positioned perpendicular to the first wall; and a shelf configured to be operably coupled with the rear bracket, wherein the shelf includes a hook configured to be received by one of the plurality of receiving wells.

7. The wall-mounted shelf assembly of claim 6, further comprising:

a first fastener configured to couple the first mounting portion with the first wall; and a second fastener configured to couple the second mounting portion with the second wall.

8. The wall-mounted shelf assembly of claim 7, wherein the first and second fasteners are weld studs.

9. The wall-mounted shelf assembly of claim 6, wherein the first wall is a rear wall of the appliance cabinet.

10. The wall-mounted shelf assembly of claim 6, wherein the shelf is configured as a bottle rack.

11. The wall-mounted shelf assembly of claim 6, further comprising:

a cover operably coupled with the second mounting portion and configured to at least partially conceal the rear bracket.

12. The wall-mounted shelf assembly of claim 11, wherein the cover is configured to match an interior surface of the appliance cabinet.

13. A wall-mounted shelf assembly for an appliance, comprising:

a rear bracket operably coupled with an appliance cabinet, the rear bracket including:

a central portion defining a plurality of receiving wells;

a first mounting portion fixedly coupled with the central portion, the first mounting portion being operably coupled with a first wall of the appliance cabinet and having a planar extent that extends parallel to a planar extent of the central portion;

a second mounting portion fixedly coupled with the central portion and the first mounting portion, the second mounting portion being operably coupled with a second wall of the appliance cabinet and having a planar extent that extends perpendicular to the planar extent of the central portion;

first and second central extensions extending from the central portion and positioned to space the central portion away from the first wall; and a support extending from the second central extension proximate the central portion of the rear bracket;

a shelf configured to be operably coupled with the rear bracket; and a cover configured to be positioned over the second mounting portion to at least partially conceal the rear bracket.

14. The wall-mounted shelf assembly of claim 13, wherein the shelf is configured to be at least partially received by one of the plurality of receiving wells.

15. The wall-mounted shelf assembly of claim 13, wherein the cover is generally L-shaped.

16. The wall-mounted shelf assembly of claim 13, wherein the shelf is at least partially flush with the cover.

17. The wall-mounted shelf assembly of claim 13, wherein the cover is operably coupled with the second mounting portion.

* * * * *